US007597634B2

(12) United States Patent
Werner et al.

(10) Patent No.: US 7,597,634 B2
(45) Date of Patent: Oct. 6, 2009

(54) PLASTIC GOLF CLUB HEAD

(75) Inventors: Frank D. Werner, Teton Village, WY (US); Richard C. Greig, Jackson, WY (US)

(73) Assignee: Origin, Inc., Jackson, WY (US)

( * ) Notice: Subject to any disclaimer, the term of this patent is extended or adjusted under 35 U.S.C. 154(b) by 262 days.

(21) Appl. No.: 11/599,131

(22) Filed: Nov. 14, 2006

(65) Prior Publication Data

US 2008/0113827 A1 May 15, 2008

(51) Int. Cl.
*A63B 53/04* (2006.01)

(52) U.S. Cl. ..... 473/345; 473/346

(58) Field of Classification Search ..... 473/324–350
See application file for complete search history.

(56) References Cited

U.S. PATENT DOCUMENTS

| | | | | | |
|---|---|---|---|---|---|
| 1,582,836 | A | * | 4/1926 | Link | 473/346 |
| 1,592,463 | A | * | 7/1926 | Marker | 473/342 |
| 1,658,581 | A | * | 2/1928 | Tobia | 473/346 |
| 2,460,435 | A | * | 2/1949 | Schaffer | 473/332 |
| 2,686,056 | A | * | 8/1954 | Oquist | 473/332 |
| 2,766,047 | A | * | 10/1956 | Karns | 473/242 |
| 2,809,838 | A | * | 10/1957 | Oquist | 473/345 |
| 3,659,855 | A | | 5/1972 | Hardesty | 273/173 |
| 3,847,399 | A | * | 11/1974 | Raymont | 473/350 |
| 4,021,047 | A | * | 5/1977 | Mader | 473/345 |
| 4,076,254 | A | * | 2/1978 | Nygren | 473/337 |
| 4,681,321 | A | * | 7/1987 | Chen et al. | 473/332 |
| 4,872,685 | A | * | 10/1989 | Sun | 473/349 |
| 4,930,781 | A | * | 6/1990 | Allen | 473/346 |
| 5,480,153 | A | | 1/1996 | Igarashi | 237/167 |
| 5,547,427 | A | | 8/1996 | Rigal et al. | 473/345 |
| 5,570,886 | A | * | 11/1996 | Rigal et al. | 473/345 |
| 5,586,949 | A | * | 12/1996 | Aizawa | 473/345 |
| 5,665,014 | A | * | 9/1997 | Sanford et al. | 473/345 |
| 5,755,627 | A | * | 5/1998 | Yamazaki et al. | 473/345 |
| 5,941,782 | A | * | 8/1999 | Cook | 473/346 |
| 6,059,669 | A | * | 5/2000 | Pearce | 473/339 |
| 6,146,571 | A | * | 11/2000 | Vincent et al. | 264/221 |
| 6,339,869 | B1 | * | 1/2002 | Peterson | 29/527.5 |
| 6,669,580 | B1 | | 12/2003 | Cackett et al. | 473/345 |
| 7,037,214 | B2 | | 5/2006 | Nakahara et al. | 473/345 |
| 7,056,228 | B2 | * | 6/2006 | Beach et al. | 473/345 |

(Continued)

OTHER PUBLICATIONS

Procedures for Measuring the Flexibility of a Golf Clubhead, United States Golf Association, Mar. 25, 2008, pp. 1-9.

*Primary Examiner*—Sebastiano Passaniti
(74) *Attorney, Agent, or Firm*—Westman, Champlin & Kelly P.A.

(57) ABSTRACT

A method of assembly of construction and assembly of golf club head parts used to manufacture golf club heads primarily composed of strong plastic materials that can be formed by injection plastic molding processes in a minimum of two parts. Draft is practical for both molded parts to simplify mold making. A preferred plastic is polycarbonate. Internal reinforcement elements are designed and arranged to provide structural features to facilitate assembly and improve strength of bonds. Internal reinforcement elements may be molded as separate parts to join with the face and shell structure. A hosel, which is not considered part of the shell and which may be made of plastic or metal, is bonded into the golf club head parts described.

14 Claims, 2 Drawing Sheets

U.S. PATENT DOCUMENTS

RE39,178 E * 7/2006 Allen ..... 473/287
7,101,289 B2 9/2006 Gibbs et al. ..... 473/329
7,258,631 B2 * 8/2007 Galloway et al. ..... 473/345

* cited by examiner

PLASTIC GOLF CLUB HEAD

FIELD OF THE INVENTION

This invention relates to design of golf club heads and in particular, to an improved design for manufacturing the head and bonding its components together using injection molded plastic components in a manner that realizes spring effect at the time of head-ball impact.

PRIOR ART

Prior art wood-type club heads have been made of various sturdy plastics with small head size, commonly expressed as small volume heads. The small volume allowed bonded joints between head parts to be broad and to have low maximum stress. Thus, the severe stresses of head-ball impact did not overstress the broad bond joints. An important and undesirable consequence of the small size and material choice was that they had negligible spring effect.

An example of such a head is shown in U.S. Pat. No. 3,659,855 (Hardesty) having an injection moldable substantially solid plastic head body and a separate attachable face plate that provides little spring effect. A wide dove-tail joint is used for positioning the face plate to the body. The face plate is held in place with plugs that are inserted into receptacles in the face plate and into channels in the body. Screws are used to hold the plugs in place. The plug inserted into a cavity in the face part stops the face from sliding off the dove-tail. The result is a small volume design with little spring effect.

Modern large club head sizes, made of plastic, which provide spring effect have been described, such as in U.S. Pat. No. 6,669,580 (Cackett et al.). Such heads can use laminated fiber pre-impregnated with plastic resin (pre-preg). The heads can not be injection molded and achieve the needed material properties. The heads shown have no internal bracing structure that is molded integral with the face or shell structures. Such pre-preg lay-up construction can approximate metal construction in many of the basic material properties. The club head shown in the '580 patent and other similar club heads are concerned with a hollow interior shell, and do not have the internal bracing described in the present patent application. The shells of the prior club heads cannot be injected molded in a two-part mold.

U.S. Pat. No. 5,480,153 (Igarashi) shows a moldable plastic rear structure and a metal face structure. There is no internal structure. Details of how the face and rear structures are bonded together are not given. The joint shown is unlikely to have ample strength, using known bonding materials.

U.S. Pat. No. 5,547,427 (Rigal et al.) shows an injection moldable shell with internal braces integral with the shell. Essential mold draft for injection molding in this construction causes the internal brace walls to be thinner at the front than at the rear, and as a result, the construction shown does not position the maximum internal brace strength near the face structure, where bracing is needed the most.

Modern large head sizes with spring effect have also been made with a metal face structure that is bonded to at least part of the shell by use of lap joints. U.S. Pat. No. 7,101,289 (Gibbs et al.) is an example of such lap joints having a metal face structure and plastic shell. The lap joint connecting the shell structure together is shown in FIG. 13.

U.S. Pat. No. 7,037,214 (Nakahara et al.) shows a metal structure with a less rigid material closing the crown portion and joined thereto with joints similar to what is described herein, but it lacks suitable internal bracing, is not suited to all-plastic injection molded construction, nor is it amenable to such internal bracing.

Internal bracing has been used in other commercially-available, compact earlier drivers, but these drivers have no significant spring effect.

A maximum weight of about 200 to 210 grams is important for heads of large size and about 180 to 190 grams is preferred. Large size is important to realize large moments of inertia for less scatter of golf shots. Within these limits, there are complicated design limitations on satisfactory performance for molded plastic heads, including structural analysis, injection molding requirements, simplicity of construction, and spring effect. These considerations are included in the present disclosure.

Driver club heads made of plastic materials have been available commercially for several years. The older and more compact types have negligible spring effect. The present disclosure describes designs and an assembly process that permits manufacture of modern, large size driver heads exhibiting spring effect, using plastic as the structural material, and with savings in manufacturing cost.

SUMMARY OF THE INVENTION

The present disclosure describes a design and assembly of wood-type golf club head parts that make it practical to manufacture golf club heads of large size that are primarily composed of strong plastic materials that in one aspect can be formed by plastic injection molding processes. The rear components of the club head (to the rear of the ball striking face structures) are collectively referred to as the "shell" in this disclosure. The shell includes the extreme rear part and what is commonly called the sole and crown of the club head. The front structure for hitting the ball is called the "face structure" and this face structure includes, and is preferably integral with, an "internal structure." The structures are bonded together. The internal structure is composed of one or more parts, called "plates." As shown, the plates are planar walls on the shell interior. A hosel structure and the mounting structure for the hosel are shown only schematically and can be formed as desired.

The present design makes use of component parts that allow a "spring effect" of the club head within the limits established by the United States Golf Association (USGA). The USGA "pendulum test" is described in the publication of the USGA entitled "Procedures for Measuring the Flexibility of a Golf Club Head" Revision 2.0, Mar. 25, 2005, the test measures the characteristic time of the golf club head. The characteristic time is the contact time between a pendulum having a mass that strikes the face center of the golf club head held in a test apparatus and the face surface of the golf club head. The contact time upper limit is 239 microseconds with a test tolerance of 18 microseconds. The USGA states that this characteristic time is indirectly related to flexibility of the golf club head and corresponds to a coefficient of restitution (COR) of 0.822 with a test tolerance of 0.008.

The present design allows injection molding each of the two or more parts for the head in a mold having as few as two parts. These two mold parts are called the "cavity" and the "core" in this disclosure. Molding draft is provided on the parts to permit withdrawal of the core and cavity from the molded part. Strong plastics that may contain chopped fiber reinforcement may be injection molded. While injection moldable components are not as strong as laminated long fibers, pre-impregnated with plastic resin (pre-preg plastics), the pre-preg plastics are not injection moldable, and thus more difficult to form. The club head of this disclosure can provide the desired spring effect. A preferred plastic is polycarbonate with or without chopped fiber filler.

It is desired to make club head designs that are easier to injection mold, and wherein the head components are more efficient to assemble. It is also desired that the club head provides the modern spring effect when the club head strikes the ball. Since the present club head has efficient stress distribution it will permit all-plastic large size heads, as is desired, with acceptable club head weight. A molded club head, as disclosed, will minimize or eliminate the need for external finishing such as grinding, painting, and labeling. The present club head provides bond joints of adequate area to join injection molded components of a golf club head that has a spring effect when assembled.

BRIEF LIST OF FIGURES

DESCRIPTION OF THE EXEMPLARY EMBODIMENT

Modern wood type golf clubs have a spring-effect face structure that is considered to be essential by most golfers. The face structure of the golf club head of the present disclosure is made of moldable polycarbonate or other moldable high strength plastic, and together with the other components, can provide the desired spring effect. Such plastics can be injection molded and may use chopped glass, graphite, Kevlar, or other fibers as fillers. This is in contrast to stronger, stiffer, long-fiber composites that require lay-up construction, as described above as prior art. The long fiber layers are usually pre-impregnated with plastic resin and cannot be injection molded. The optional short or "chopped" fiber-filled moldable plastics disclosed herein are stronger, have higher Young's modulus of elasticity, and higher density than the pure plastics. The preferred material is polycarbonate, with chopped fiber glass or other fiber fillings from zero up to 50%. Polycarbonate excels for impact strength. It can be marred, but is resistant to scratching.

Figure 1:
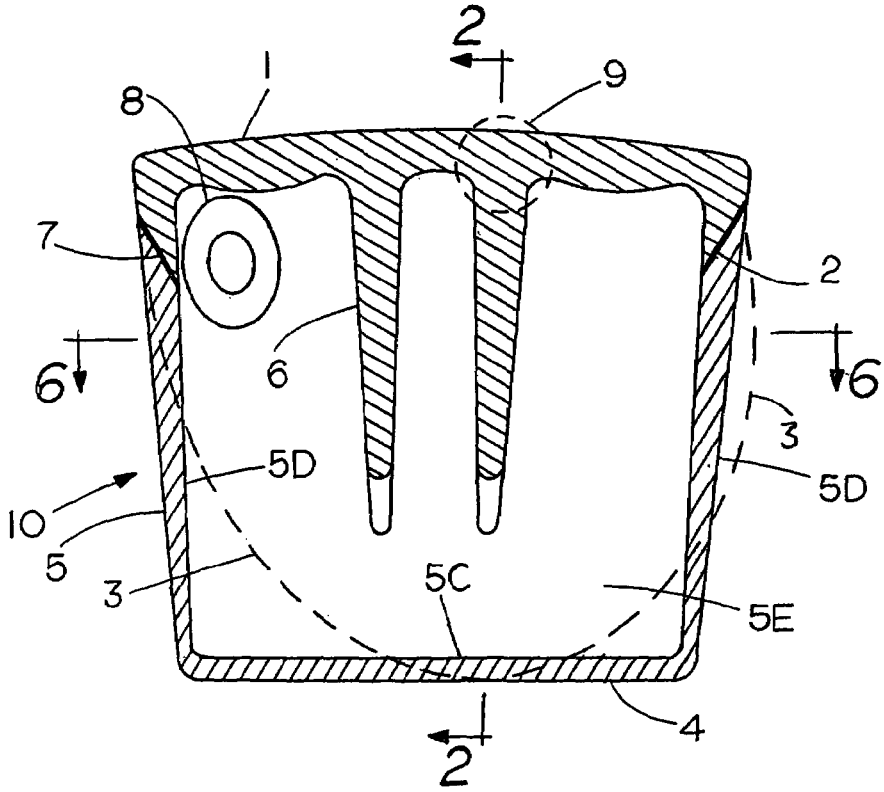
FIG. 1 is a horizontal cross sectional view of a driver head at half of the head's height and looking downward, as indicated at line 1-1 in FIG. 2.

The cross sectional view of FIG. 1 shows a club head 10 having a face structure 1 with plates 6 forming an internal structure. A shell 5 of the club head has a crown wall or top wall 5A, a sole or bottom wall 5B, and a rear wall 5C with a rear surface 4. Sides 5D of the shell, in combination with the other walls define an open front, but otherwise enclosed, cavity 5E. Sides 5D of the shell, in combination with the other walls define an open front but otherwise enclosed center cavity 5E. The internal structure plates 6 are molded integral with the face structure 1 and extend rearwardly and have top and bottom edges bonded to the shell 5.

In FIG. 1 the club head 10 is shown as an approximately square shape as viewed from the top. The club head may be adapted to the more conventional wood-type head shapes indicated by dashed line 3 in FIGS. 1 and 2. Such adaptation or change of shape requires the internal structure plates 6 to be reoriented to be nearly parallel to critical parts of the conventional shell to allow use of a two-part mold. The rectangular shape shown in solid lines in FIGS. 1 and 2 allows for better mass distribution where concentrated weights (not shown nor a part of this invention) are bonded into molded pockets in corners of the head as desired to realize best center of gravity location and highest practical moments of inertia.

Figure 2:
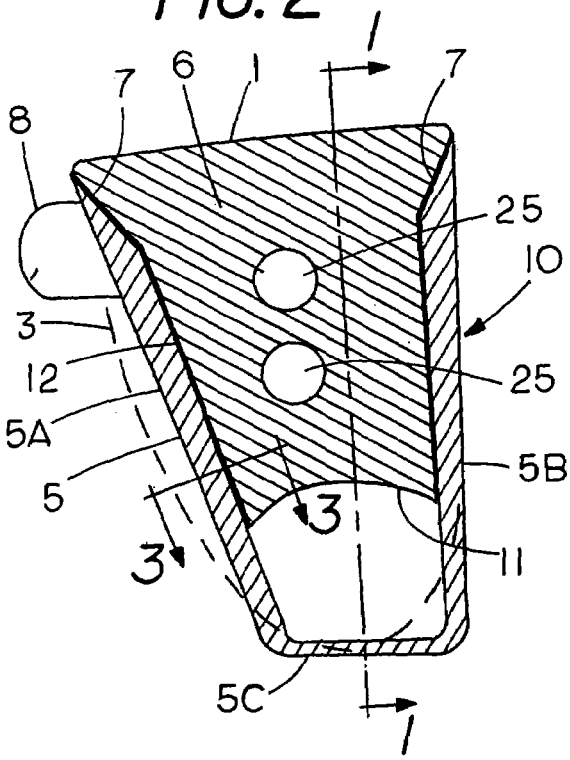
FIG. 2 is a cross sectional view taken along line 2-2 in FIG. 1.
Figure 4:
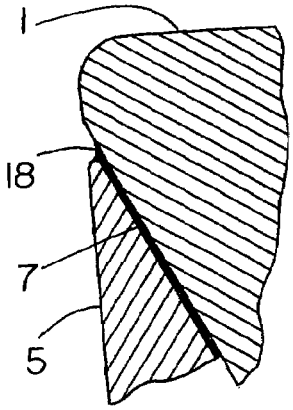
FIG. 4 is an enlarged cross sectional view of the finished external bond joint of the shell to the face structure, as shown at the upper left corner of FIG. 2.

The perimeter of the face structure 1 is bonded to the shell 5 with a lap joint 7 shown in FIGS. 1 and 2 in enlarged in FIG. 4. The lap joints 7 are slanted rather than using an edge surface of wall perpendicular to a surface being joined, to provide much greater area for the bond than for an edge surface that is perpendicular to the surface being joined, which is limited by the thickness of the wall.

Figure 3:
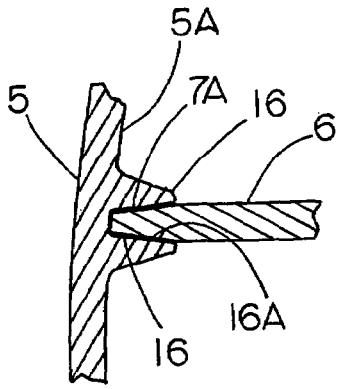
FIG. 3 is a cross sectional view taken along line 3-3 in FIG. 2.

FIG. 3 shows an enlarged cross sectional view of a portion of the shell shown in FIG. 2. Here, shell 5 has spaced short walls 16 molded in its inner surface forming grooves 16A to accept the edge portions of the plates 6 forming the internal structure. The bond joint between walls 16 and the edge portion of plate 6 is indicated at 7A. The surfaces of the grooves 16A formed by walls 16 provide increased bond area as compared to a simple bond joint, and also the grooves guide internal structure plates 6 into the proper position at the time of assembly.

Figure 5:
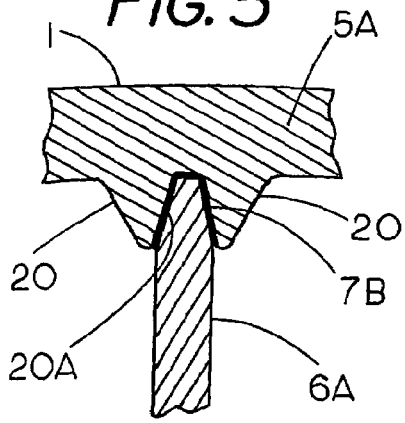
FIG. 5 is a modified view of the section shown at dashed circle 9 in FIG. 1, showing an alternate construction in which internal structure plates are molded separately and later joined to the club face structure.

In the modified showing of FIG. 5, the face structure 1 is provided with wall portions 20 forming grooves 20A to receive end edge portions of plates 6A forming internal structures, and a bond joint 7B is made in the groove 20A to bond plate 6A in place.

The bond joint adhesive layers are rather thick, preferably using flexible epoxy such as manufactured by 3M, identified as #2216. This epoxy has about one fifth the value for Young's modulus as compared with unfilled polycarbonate and even a lower proportion of the Young's modular value of chopped fiber filled plastic. Being somewhat flexible, and if the bond adhesive layer is relatively thick as indicated at bond joints 7, 7A and 7B in the figures, the bond material can deform slightly to cushion the severe transient, short duration stresses at head-ball impact.

Assembly of the head components consists of an operator applying the epoxy or similar bonding material in the grooves 16A at joints 7A shown in FIG. 3 and on the joints 7. This is done efficiently by use of a commercially available mixing nozzle system that mixes and ejects a stream of the bonding material at the press of a trigger. Next, the face structure 1, including the internal structure plates is pushed into place into the shell cavity and the excess bond material is wiped off the external joint areas, using a suitable solvent if needed. The assembly of the face structure-internal structure and shell may then be heated to accelerate cure of the bonding material.

This manufacturing and assembly process is quite simple as compared with weld joints in an all-metal welded joint club head and as compared to pre-preg lay-up head construction. Further, colorant can be added to the plastic before molding. In addition, the mold can provide a finish with a slightly pebbled surface, a shiny surface, other finish, or a surface with lines or other decor. Selected wording and designs can also be molded on the club head, for example, with contrasting surface finishes. Raised or recessed lettering or other symbols may be molded into the rear side of the shell rear part 4. The need for external grinding, finishing, labeling, and painting is eliminated, with considerable saving in production cost.

As can be seen, the plates 6 forming the internal structure can be designed to provide substantial mechanical support for the face structure. It is particularly important to note that this internal structure supports the shell 5 from bulging and bending on impact, thus allowing lower weight for the shell. This also markedly reduces shell vibrations at impact that otherwise make a loud sound that many golfers find to be objectionable. In addition this construction relieves some of the stress at the perimeter of the face-structure-shell joint, with related weight saving. A disadvantage is that the result is likely to have somewhat more structural weight than more conventional designs, allowing less weight to distribute elsewhere to adjust the location of the center of gravity and increase the moments of inertia. This is partly counteracted by density being much lower for plastic compared to metal construction. With the high moments of inertia for modern "oversize" heads, such as for the present invention, optimum location of the center of gravity and small reduction of moments of inertia are not critical. By comparison these factors were much more critical for early, compact head designs.

Both parts, the face with integral internal structure and the shell, have draft that is essential for the mold parts to allow the core to be pulled from the front, so that each mold needs only two parts, the cavity and the core. Draft on internal structure plates 6 causes greater thickness where they join the face structure, and this gives more strength where needed for impact loads, as compared with uniform thickness plates or plates having a thickness that is greater at the rear than at the front.

The construction could be adapted to more conventional club head shapes such as indicated by dotted lines 3 in FIGS. 1 and 2. This requires small changes in alignment of the club head components to allow for core pulling.

The bond of the face structure to the shell is shown at 7 and other joints are also marked at 7A and 7B. A strong, slightly flexible epoxy is a good choice, such as #2216 epoxy sold by 3M, as noted above. Solvent bonding of polycarbonate to polycarbonate can make an even stronger bond. However solvent bonding requires excellent fit between parts and has no cushioning effect for impact loads. Another advantage for use of #2216 or similar bonding agent is that it copes very well with small gaps between parts being bonded, which is impossible with solvent bonding. For assurance of adequate strength of the bond joints, the mating surface area may be made much larger by a sloping mating surface as shown at 7 in FIGS. 1, 2 and 4 and by using grooves for bonding plates to the shell as shown at 7A and 7B in FIGS. 3 and 5. A bond at the edge surface of the molded walls is not strong enough for the loads encountered.

The shaft socket or hosel is represented schematically at 8 in FIG. 1. The hosel can take the form of a simple tube molded of plastic or made of metal and bonded in place in holes molded or drilled into suitable blocks of material molded into the face structure and/or the shell structure. This is a well-known design process. With appropriate mold complications, the hosel can be injection molded to be integral with the face structure and/or the shell structure.

The generally square shape of the shell shown in FIG. 1 allows better weight distribution, since concentrated weight such as tungsten can be added at the corners. Pockets for such weighting are not shown for simplicity, but are well known in the art, and are readily molded as desired. For this purpose, such pockets may be filled by bonding a metal weight in place with epoxy or the like. Such weights are valuable for control of the location of the head's center of gravity and for realizing large moments of inertia for the head. Since total head weight should not be unduly raised, increasing such weights is the main reason for minimizing weight of the shell structure and the internal structure. Analysis indicates that extra weight in the rear, heel corner is usually most important for maximum distance for hits at the face center.

Stiffness is an important consideration since most current driver faces have the spring effect in which the face deforms and acts as a spring to provide somewhat more launch velocity of the ball. The present invention provides such spring effect by proper choice of the plastic and dimensions of the component parts. For example, the thickness of the interior plates can be varied in relation to the thickness and outer dimensions of the face structure, the length of the interior plates, and the resiliency of the molded plastic and the flexibility of the epoxy can be varied. The "spring effect" is called the coefficient of restitution (COR) as mentioned above. The COR can be determined by the equation set forth in U.S. Pat. No. 7,101,289 and is a function of the club head and ball velocities prior to impact and the velocities of the club head and ball just after separation. The COR may be between 0.81 and 0.9 with a preferable range of 0.82 to 0.87. The most preferred in COR is 0.83, which conforms to the USGA acceptable upper COR limit.

The internal structure in one form is shown as plates 6 in FIGS. 1, 2, and 3. There may be only one plate, but two plates (as shown) and more are also satisfactory.

Figure 6:
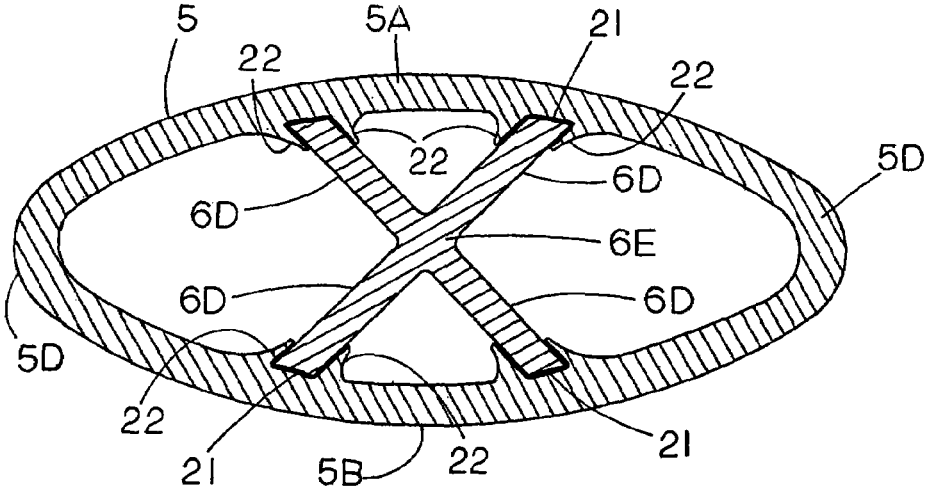
FIG. 6 is a vertical cross sectional view of a modified club head with the view taken as shown by line 6-6 in FIG. 1 with an internal structure comprising non-parallel, intersecting plates.

Alternate constructions may be used as shown in FIGS. 5 and 6. The FIG. 5 modification comprises molding internal structure plates 6A separately from the face structure 1. The plates 6A and face structure 1 can then be joined together as shown in FIG. 5, preferably using grooves 20A formed between short walls 20 to increase the bond area of face 1 to plates 6A as was discussed in connection with FIG. 3.

The plate or plates 6 or 6A may be designed to be thinner or thicker and to extend less far or farther from the face, or even all the way back to the rear part 4. These design variations can be optimized for minimum weight and/or to adjust the spring effect to a suitable value. One or more holes can be formed in the plates for the same reasons if the plates are molded separately from the face structure. Such holes are shown at 25 in FIG. 2. If the plates are integral with the face, holes may be molded in the plates by use of lateral cylinders in the mold that are pulled prior to separating the cavity and core.

As shown in FIG. 6, the internal plates may be positioned at various angles relative to one another. As shown in FIG. 6, plates 6D can be non-parallel and may even intersect one another as shown at 6E. The plates 6D are held with epoxy in grooves 21 formed by short walls 22. The plates 6D can extend from the face structure rearwardly about the same distance as plates 6 shown in FIG. 2. It is generally preferred that the plates 6, 6A and 6D be straight (planar) in the front-back direction. As shown in FIG. 2, any one or all of the plates forming internal structures in the different embodiments can be provided with one or a plurality of through holes 25 to reduce weight.

FIG. 4 shows a bonded joint between the face structure 1 and the perimeter of the shell 5. It shows how the excess bonding material at the lap joint 7 can be wiped away with solvent for the bonding resin if desired, to leave a neat external bond edge shown at 18.

Figure 7:
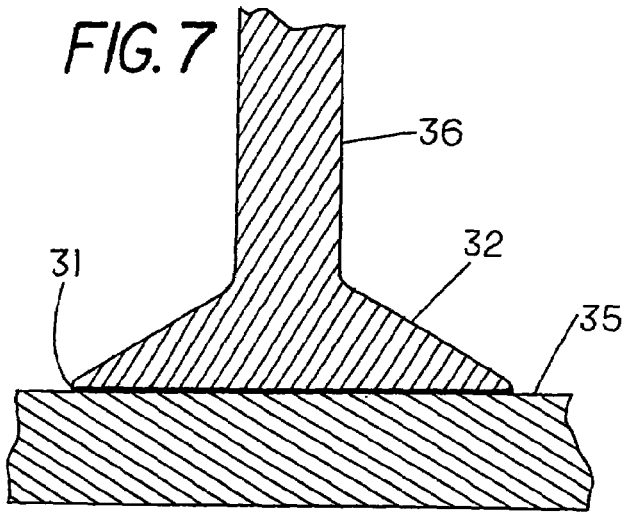
FIG. 7 is a fragmentary cross sectional view of a modified bonded joint between an internal structure plate and a wall of the club head.

Numerous trial models of related shapes have been made and tested to destruction with a ball-head impact, by known air gun methods. It was found that the bond area must be at least 20% larger area than the cross sectional area of the weaker of the two wall sections being joined, where the weaker section's cross sectional area is measured in the vicinity of the bond in the direction perpendicular to the surface of the wall and at a location of maximum stress in the weaker wall section. A higher percentage bond area is preferred. The bond area could be a flange resembling that of a T beam as shown in FIG. 7. In FIG. 7, a plate of the internal structure is shown as 36 with a flange 32 extending laterally of the plate 36 to provide increased bonding area compared to an edge surface of the plate. The adhesive 31 bonds the plate 36 to a wall 35 of either the shell structure or face structure.

As described in FIGS. 3, 5, & 6, the extra bond area is provided by the walls that form the grooves that serve the supplemental purpose of guiding the plates 6, 6A and 6D edges when they are pushed into the grooves for final assembly.

If desired the front hitting surface of face structure 1 can be covered, such as with a bonded-on thin metal plate or a layer of long-fiber pre-preg, however polycarbonate is generally suitable for many hits before serious damage in this area. Such coatings are optional.

The disclosed designs may also be used for fairway woods, but are not important for irons, especially the most lofted irons, since a rear shell is generally not used.

Although the present invention has been described with reference to preferred embodiments, workers skilled in the art will recognize that changes may be made in form and detail without departing from the spirit and scope of the invention.

What is claimed:

1. A golf club head having a plastic front portion and a plastic rear portion, the front portion including a ball striking face, the rear portion forming a rear shell including walls forming top, bottom and sides defining an interior, the front portion having at least one rearwardly projecting plate integral therewith and fitting within the interior of the shell and having edges, a perimeter of the ball striking face mating with a perimeter of the shell, the perimeter of the ball striking face and edges of the at least one rearwardly projecting plate being bonded to walls forming the shell, and the at least one rearwardly projecting plate having a thickness, the thickness of the at least one rearwardly projecting plate being greater adjacent the ball striking face than at rear portions of the at least one rearwardly projecting plate.

2. The golf club head of claim 1, wherein said shell has an open front but is otherwise enclosed by a rear wall and by the walls forming the top, bottom and sides.

3. The golf club head of claim 1, wherein the perimeter of the shell mating the perimeter of the ball striking face defines an opening, and the at least one rearwardly projecting plate having top and bottom edges that fit between the top and bottom walls of the shell.

4. The golf club head of claim 1, wherein the at least one rearwardly projecting plate is spaced from a rear of the shell.

5. The golf club head of claim 1 wherein there are at least two rearwardly extending plates extending from the front portion rearwardly, the two plates being non-parallel.

6. The golf club head of claim 5 wherein said non parallel plates intersect along a front to rear extending line.

7. The golf club head of claim 5 wherein the plates have a plurality of holes therethrough.

8. A golf club head having a plastic front portion and a plastic rear portion, the front portion including a ball striking face, the rear portion forming a rear shell including walls forming top, bottom and sides defining an interior, the front portion having at least one rearwardly projecting plate integral therewith and fitting within the interior of the shell and having top and bottom edges that slide into grooves formed in top and bottom walls of the shell, and a perimeter of the ball striking face mating with a perimeter of the shell, the perimeter of the ball striking face and the top and bottom edges of the at least one rearwardly projecting plate being bonded to walls forming the shell.

9. A golf club head having a plastic front portion and a plastic rear portion, the front portion including a ball striking face, the rear portion forming a rear shell including walls forming top, bottom and sides defining an interior, the front portion having at least one rearwardly projecting plate integral therewith and fitting within the interior of the shell and having edges, a perimeter of the ball striking face mating with a perimeter of the shell, the perimeter of the ball striking face and edges of the at least one rearwardly projecting plate being bonded to walls forming the shell, and wherein a surface defining the perimeter of the ball striking face, and a mating perimeter surface of the shell are slanted to increase the area of mating surface portions of the perimeters.

10. The golf club head of claim 9, wherein there are two rearwardly projecting plates each integral with the ball striking face, and extending rearwardly therefrom, said plates having generally central planes extending between top and bottom walls of the shell, and being tapered to have a greater thickness where the plates are integral with the ball striking face than at ends thereof toward a rear of the golf club head.

11. The golf club head of claim 10, wherein the rearwardly projecting plates have openings defined therein for reducing weight.

12. A golf club head having a molded plastic front portion including a wall having a ball striking face, and at least one integral rearwardly projecting plate extending from the front portion and having top and bottom edges, a golf club head shell having walls defining an interior, with spaced top and bottom walls, sides, and a rear, said shell having an open front end with a front perimeter, the ball striking face having a perimeter mating with the front perimeter of the front end of the shell and being bonded thereto, and said at least one rearwardly projecting plate having top and bottom edges supporting and being bonded to the top and bottom walls of the shell, and the rearwardly projecting plate being tapered in thickness with a thickest portion of the rearwardly projecting plate being integral with the wall having the ball striking face.

13. The golf club head of claim 12, wherein said at least one rearwardly projecting plate has openings therethrough for reducing weight.

14. The golf club head of claim 12, wherein the perimeter of said ball striking face, and the perimeter of the front end of said shell are defined by slanted surfaces to increase the surface area of the joining perimeters for bonding purposes.

* * * * *